US008574136B1

(12) United States Patent
Burstrom

(10) Patent No.: US 8,574,136 B1
(45) Date of Patent: Nov. 5, 2013

(54) BARBELL HAVING PARALLEL FOREARM ENGAGING BAR

(76) Inventor: Donald Burstrom, Frankfort, IL (US)

( * ) Notice: Subject to any disclaimer, the term of this patent is extended or adjusted under 35 U.S.C. 154(b) by 435 days.

(21) Appl. No.: 12/946,654

(22) Filed: Nov. 15, 2010

(51) Int. Cl.
*A63B 21/072* (2006.01)
*A63B 21/06* (2006.01)

(52) U.S. Cl.
USPC ..... 482/109; 482/108; 482/139

(58) Field of Classification Search
USPC ..... 482/105–109, 139, 92, 93; D21/679–682
See application file for complete search history.

(56) References Cited

U.S. PATENT DOCUMENTS

| | | | | | |
|---|---|---|---|---|---|
| 1,658,108 | A | * | 2/1928 | Vaughn | 482/109 |
| 2,617,650 | A | * | 11/1952 | Landis | 482/108 |
| 3,918,710 | A | * | 11/1975 | Niebojewski | 482/97 |
| 4,029,312 | A | * | 6/1977 | Wright | 482/108 |
| 4,231,569 | A | * | 11/1980 | Rae | 482/108 |
| 4,252,316 | A | * | 2/1981 | Price | 482/106 |
| 4,312,506 | A | * | 1/1982 | Brennan | 482/108 |
| 4,327,908 | A | * | 5/1982 | James | 482/105 |
| D276,835 | S | * | 12/1984 | Killen | D21/679 |
| D280,840 | S | * | 10/1985 | Dzitzer | D21/679 |
| 4,607,840 | A | * | 8/1986 | Harper | 482/109 |
| 4,756,526 | A | * | 7/1988 | Broussard | 482/108 |
| 4,768,780 | A | * | 9/1988 | Hayes | 482/108 |
| 4,822,035 | A | * | 4/1989 | Jennings et al. | 482/106 |
| 4,872,667 | A | * | 10/1989 | Favot | 482/106 |
| 4,943,052 | A | * | 7/1990 | Powers | 482/108 |
| 4,964,631 | A | * | 10/1990 | Marano | 482/93 |
| 5,088,725 | A | * | 2/1992 | Arnold | 482/97 |
| D324,894 | S | * | 3/1992 | Porcello | D21/679 |
| 5,110,119 | A | * | 5/1992 | Arnold | 482/93 |
| 5,540,640 | A | * | 7/1996 | Povilaitis | 482/108 |
| D378,386 | S | * | 3/1997 | Brubaker | D21/680 |
| D381,716 | S | * | 7/1997 | Nava, Jr. | D21/680 |
| D394,685 | S | * | 5/1998 | Eckmann | D21/680 |
| D398,675 | S | * | 9/1998 | Marney | D21/681 |
| D416,959 | S | * | 11/1999 | Tumminia | D21/662 |
| D425,151 | S | * | 5/2000 | Landfair | D21/681 |
| 6,213,921 | B1 | * | 4/2001 | Frey | 482/105 |
| 6,340,341 | B1 | * | 1/2002 | Purcell | 482/108 |
| 6,592,497 | B2 | * | 7/2003 | Greenheck | 482/93 |
| 6,715,728 | B2 | * | 4/2004 | Nielsen | 248/339 |
| 7,081,072 | B2 | * | 7/2006 | Allen | 482/106 |
| 7,303,507 | B1 | * | 12/2007 | Jozsa | 482/50 |
| 7,794,377 | B2 | * | 9/2010 | Amzallag et al. | 482/141 |
| D633,156 | S | * | 2/2011 | Caswell et al. | D21/679 |
| D633,961 | S | * | 3/2011 | Loew et al. | D21/679 |
| 7,963,891 | B1 | * | 6/2011 | Zeaman | 482/104 |
| D647,152 | S | * | 10/2011 | Sibley | D21/679 |
| 2006/0105890 | A1 | * | 5/2006 | Logue | 482/106 |
| 2006/0252612 | A1 | * | 11/2006 | Melcer | 482/94 |
| 2011/0177922 | A1 | * | 7/2011 | Selinger | 482/107 |

* cited by examiner

*Primary Examiner* — Stephen Crow
(74) *Attorney, Agent, or Firm* — Kyle Fletcher

(57) ABSTRACT

The Barbell having parallel forearm engaging bar is an accessory for use with a barbell. The accessory can be installed upon an existing barbell and includes a second bar that is parallel with the barbell by a distance defined by a cross brace. The second bar features a paid of foam pads that engage the forearm of an end user so as to minimize wrist strain during a curling exercise with the barbell. The accessory includes a clamp assembly that enables the accessory to be installed and/or removed from the barbell.

15 Claims, 4 Drawing Sheets

105
106
100
104
102E
102C
101
103A
102
103A 103
102A
103
102A
102B
106
105

BARBELL HAVING PARALLEL FOREARM ENGAGING BAR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of weightlifting equipments, more specifically, a barbell that has an accessory integrated or attached thereon and of which includes a parallel bar that engages upon the forearm of an end user.

Curling weights on a barbell can cause pain and strain to the wrists of an end user. The strain to a wrist is similar to carpal tunnel syndrome, and can impact the ability to perform other functions associated with the respective hands. There is a need for a device that enables an end user to continue to perform curling exercises with weighted barbells without the risk of strain to the wrist.

B. Discussion of the Prior Art

As will be discussed immediately below, no prior art discloses an accessory that attaches onto a barbell and of which barbell and separated by a predefined distance; wherein the second bar is for engagement of a small portion of a forearm of an end user; wherein the accessory works with the forearms of an end user to minimize wrist strain during curling exercises with the use of a barbell.

The Favot Patent (U.S. Pat. No. 4,872,667) discloses a weightlifting apparatus for increasing the effective weight by offsetting it from a shaft enclosed in a sleeve gripped by the user. However, the apparatus is not an accessory for use with a barbell, which attaches onto a barbell and works with a forearm of an end user to reduce strain to the wrist when curling weights on the barbell.

The Brennan Patent (U.S. Pat. No. 4,312,506) discloses a bicep exercising curling bar, that to avoid pronation of the wrists, permits curling exercises in the palms up, supine, hand position, without undue and prolonged wrist strain. However, the curling bar is not an accessory that is installed upon an existing barbell and of which extends away from the barbell to provide a second cushion that engages a small portion of the forearm in order to reduce strain on the wrist during a curling exercise with the barbell.

The De La Garza Patent (U.S. Pat. No. 6,572,515) discloses a dumbbell and barbell stabilizer-isolator device. However, the stabilizer-isolator device does not attach onto an a predefined distance upon which a small portion of an end user's forearm engages and aids in curling weights on a barbell during curling exercises.

The Carpenter Patent (U.S. Pat. No. 5,573,484) discloses a weighted auxiliary handle for a dumbbell. However, the auxiliary handle is for use with a dumbbell and not a barbell, and does not reduce wrist strain when curling weights on a barbell.

The Hayes Patent (U.S. Pat. No. 4,768,780) discloses a device that facilitates the user's grasp and ability to lift a weight when the hand is oriented in a palm down position. Again, the device is for use with a dumbbell and not a barbell, and does not reduce wrist strain when curling weights on a barbell.

While the above-described devices fulfill their respective and particular objects and requirements, they do not describe an accessory that attaches onto a barbell and of which provides a second bar that is generally parallel with the barbell and separated by a predefined distance; wherein the second bar is for engagement of a small portion of a forearm of an end user; wherein the accessory works with the forearms of an end user to minimize wrist strain during curling exercises with the use of a barbell. In this regard, the Barbell having parallel forearm engaging bar departs from the conventional concepts and designs of the prior art.

SUMMARY OF THE INVENTION

The Barbell having parallel forearm engaging bar is an accessory for use with a barbell. The accessory can be installed upon an existing barbell and includes a second bar that is parallel with the barbell by a distance defined by a cross brace. The second bar features a paid of foam pads that engage the forearm of an end user so as to minimize wrist strain during a curling exercise with the barbell. The accessory includes a clamp assembly that enables the accessory to be installed and/or removed from the barbell.

It is an object of the invention to provide an accessory that is installed upon a flat barbell and of which provides pads for engagement of forearms of an end user to minimize wrist strain when curling weights on said barbell.

A further object of the invention is to provide a cross brace that extends a second bar from the barbell by a distance, and wherein the second bar is parallel with respect to the barbell.

A further object of the invention is to provide foam pads on the second bar to comfortably engage the forearm of an end user when curling weights on the barbell.

A further object of the invention is to provide an optional set of foam pads that attach onto the barbell.

These together with additional objects, features and advantages of the barbell having parallel forearm engaging bar will be readily apparent to those of ordinary skill in the art upon reading the following detailed description of presently preferred, but nonetheless illustrative, embodiments of the Barbell having parallel forearm engaging bar when taken in conjunction with the accompanying drawings.

In this respect, before explaining the current embodiments of the barbell having parallel forearm engaging bar in detail, it is to be understood that the barbell having parallel forearm engaging bar is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the barbell having parallel forearm engaging bar.

It is therefore important that the claims be regarded as including such equivalent construction insofar as they do not depart from the spirit and scope of the barbell having parallel forearm engaging bar. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
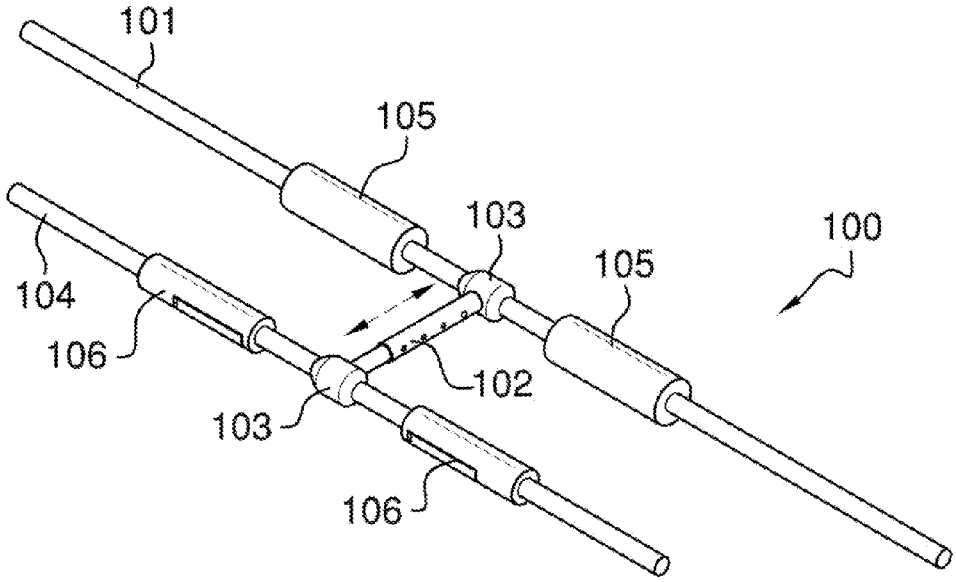
FIG. 1 illustrates a front, isometric view of the barbell having parallel forearm engaging bar fully assembled and without weights added thereon.
Figure 2:
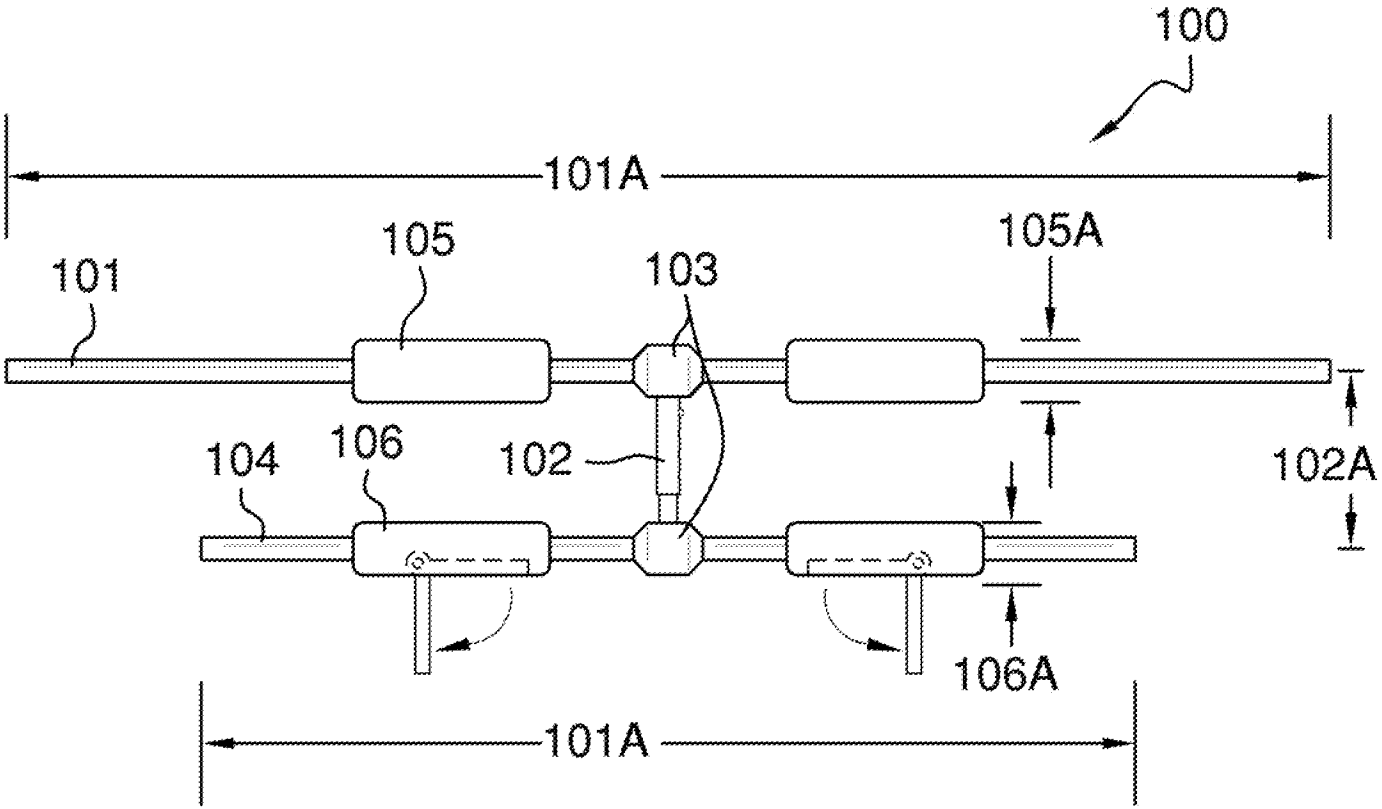
FIG. 2 illustrates a top view of the barbell having parallel forearm engaging bar by itself.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A barbell having parallel forearm engaging bar 100 (hereinafter invention) includes a barbell 101 upon which the invention 100 is installed to enable an end user 130 to curl weights 131 with the barbell 101 while minimizing wrist strain to the end user 130. It shall be noted that the invention 100 is designed for use with a barbell 101 that is simply a straight bar upon which the weights 131 are added at each end.

The invention 100 includes a cross brace 102, and two clamp assemblies 103. The cross brace 102 has a clamp assembly 103 at each end of the cross brace 102. A second bar 104 attaches to one of the two clamp assemblies 103; whereas the opposing clamp assembly 103 attaches to the barbell 101. The cross brace 102 and the clamp assemblies 103 are responsible for (1) maintaining the second bar 104 at a distance 102A from the barbell 101, and (2) maintaining the second bar 104 in a parallel orientation with respect to the barbell 101.

Foam pads 105 attach onto the barbell 101 in order to provide a comfortable place with which the end user 130 grabs the barbell 101 with his/her hands 130A. The foam pads 105 are made of a soft foam material that when gripped by the hands 130A increases the overall diameter of the barbell 101, which will reduce muscular strain to the hands 130A and wrists 130C.

Second foam pads 106 attach onto the second bar 104 and provide a comfortable place with which the end user 130 engages a small portion of a forearm 130B against the second bar 104 in order to aid in curling the barbell 101 and weights 131 in order to reduce strain to the wrist 130C of the end user 130.

The second foam pads 106 are made of the same material as the foam pads 105. It shall be noted that the overall diameter of the foam pads 105 may be greater than the overall diameter of the second foam pads 106 (see FIG. 5 as a reference). However, the overall diameter of the foam pads 105 may be the same as the overall diameter of the second foam pads 106 (see FIG. 3 as a reference).

Figure 3:
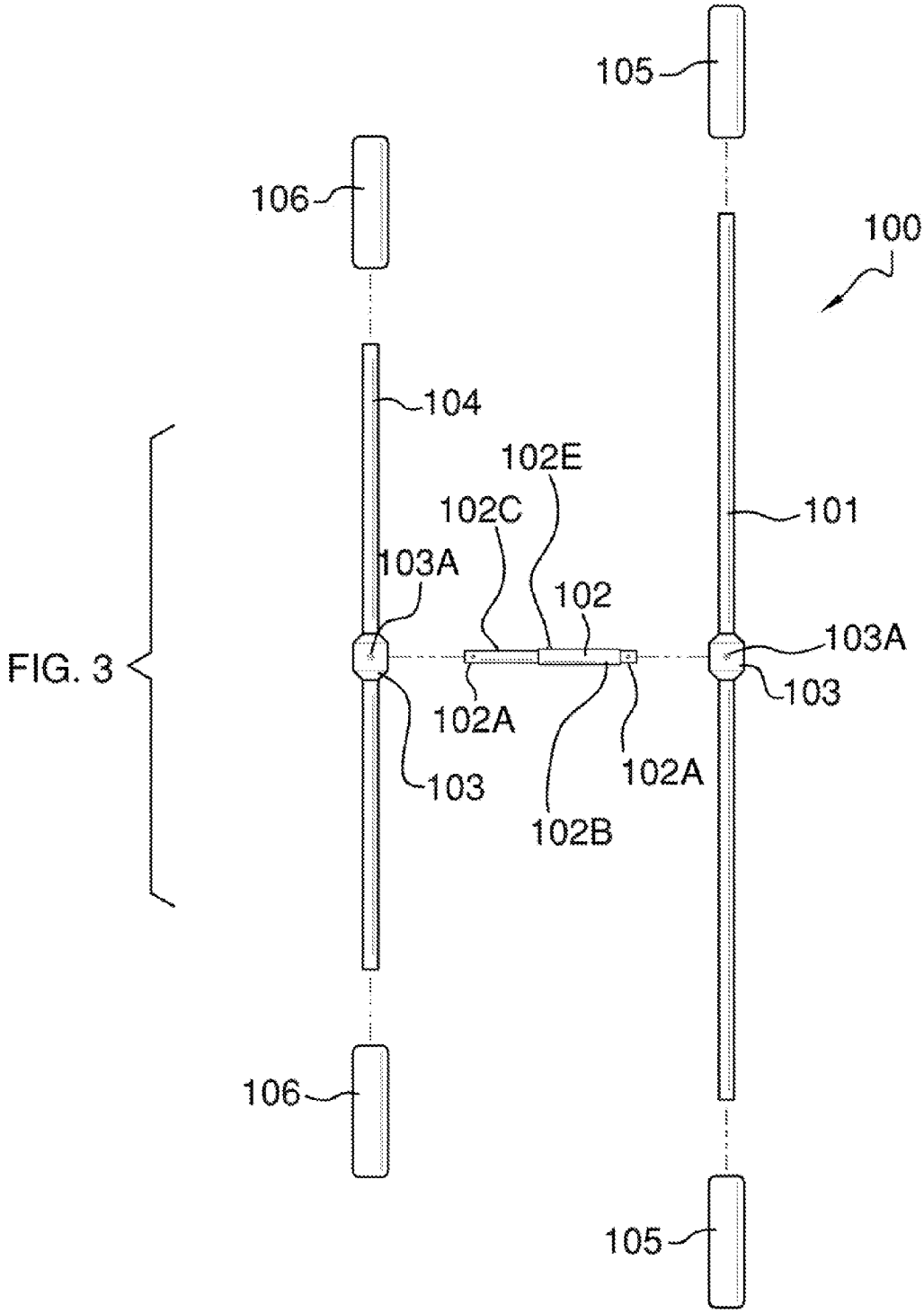
FIG. 3 illustrates an exploded view of the barbell having parallel forearm engaging bar and detailing the inter-connection of the foam pads to the respective bar as well as the clamp assembly responsible for connecting the two bars in parallel relationship with one another.
Figure 4:
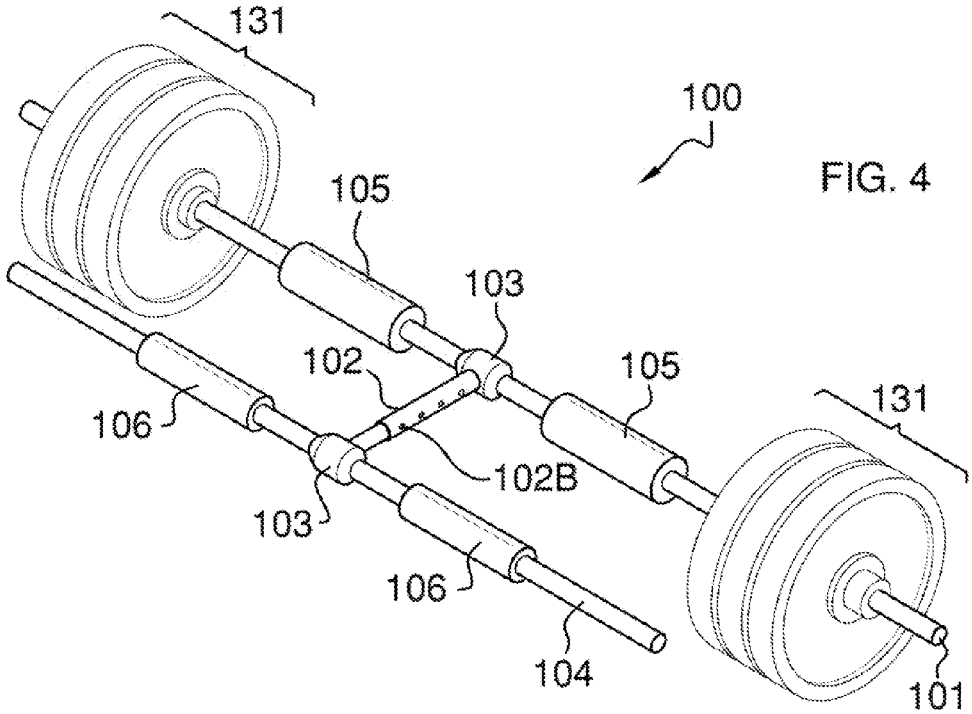
FIG. 4 illustrates a front, isometric view of the barbell having parallel forearm engaging bar fully assembled and with weights added thereon.
Figure 5:
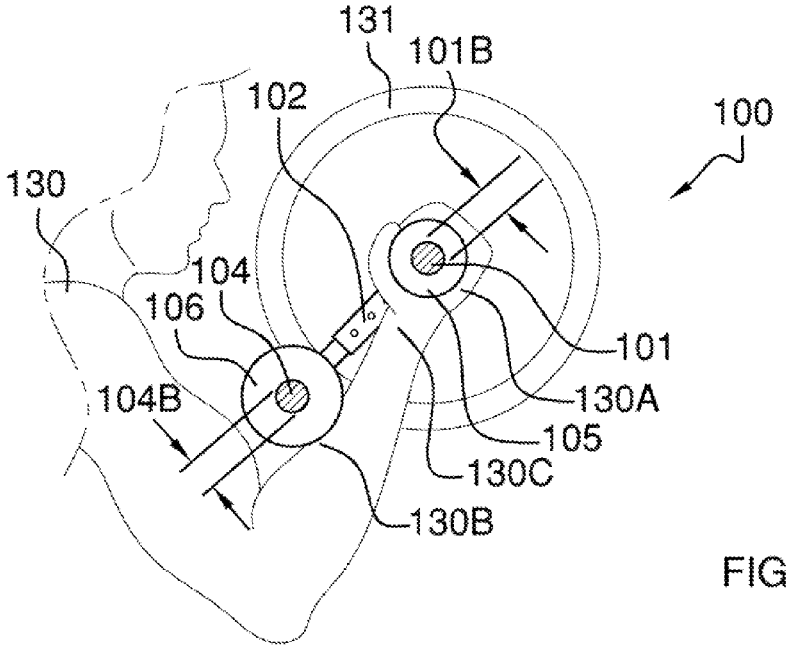
FIG. 5 illustrates a side view of the barbell having parallel forearm engaging bar in use.

The second bar 104 has an overall length 104A less than an overall length 101A of the barbell 101 (see FIG. 3 as a reference). A diameter 104B of the second bar 104 may be equal to or less than a diameter 101E of the barbell 101. The barbell 101, the cross brace 102, and the second bar 104 may be made of a metallic material customarily used with weightlifting equipment.

The clamping assemblies 103 attach onto locations respective of the barbell 101 and the second bar 104. Each clamping assembly 103 has a setscrew 103A that when tightened screws down onto an outer surface of the barbell 101 and the second bar 104 to secure the clamping assembly 103 thereon.

The cross brace 102 is secured to the clamping assembly 103 via a set pin 102A, which locks inside of the clamping assembly 103 when affixed.

The cross brace 102 can be adjusted in length via a first piece 102B and a second piece 102C. The first piece 102B has a plurality of holes 102D running the length; whereas the second piece 102C has a spring-loaded pin 102E that interlocks with one of the holes 102D to define the length of the cross brace 102 when in use.

The invention 100 is used to distribute the overall weight of the invention 100 plus the weights 131 onto the forearms 130B and the hands 130A of the end user 130, which will reduce muscular strain to the hands 130A and the wrists 130B.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A barbell having parallel forearm engaging bar comprising:

a cross brace having a clamping assembly mounted at each end which attaches to a barbell and said bar;

wherein the barbell and the bar are parallel with respect to one another and are separated by a distance defined by a length of the cross brace;

wherein the barbell is configured to be held by the hands of a user and the bar is configured to engage forearms of said user in order to distribute weights on said barbell between the hands and the forearms, which reduces muscular strain to the hands and wrists of said user when performing curling exercises with the barbell;

wherein the barbell and the bar are perpendicularly oriented with respect to the hands and the forearms of the user, whereas the cross brace is parallel with and positioned in between the hands and the forearms of the user.

2. The barbell having parallel forearm engaging bar as described in claim 1 wherein foam pads are added to the barbell to provide a surface for hands of the end user to grab.

3. The barbell having parallel forearm engaging bar as described in claim 2 wherein second foam pads are added to the bar to provide a surface for the forearms to engage.

4. The barbell having parallel forearm engaging bar as described in claim 3 wherein the foam pads have a diameter greater than or equal to the overall diameter of the second foam pads.

5. The barbell having parallel forearm engaging bar as described in claim 1 wherein the bar has an overall length less than an overall length of the barbell.

6. The barbell having parallel forearm engaging bar as described in claim 1 wherein the clamping assemblies each include a setscrew that tightens onto an outer surface of either the barbell or the bar to secure the clamping assembly thereon.

7. The barbell having parallel forearm engaging bar as described in claim 1 wherein the bar has a diameter less than or equal to a diameter of the barbell.

8. The barbell having parallel forearm engaging bar as described in claim 1 wherein the cross brace can be adjusted in length, and is further defined by a first piece and a second piece; wherein the first piece has a plurality of holes running the length; whereas the second piece has a spring-loaded pin that interlocks with one of the holes to define the length of the cross brace when in use.

9. A barbell having parallel forearm engaging bar comprising:

a cross brace having a clamping assembly mounted at each end which attaches to a barbell and said bar;

wherein the barbell and the bar are parallel with respect to one another and are separated by a distance defined by a length of the cross brace;

wherein the barbell is configured to be held by the hands of a user and the bar is configured to engage forearms of said user in order to distribute weights on said barbell between the hands and the forearms, which reduces muscular strain to the hands and wrists of said user when performing curling exercises with the barbell;

wherein foam pads are added to the barbell to provide a surface for hands of the end user to grab;

wherein second foam pads are added to the second bar to provide a surface for forearms to engage;

wherein the barbell and the bar are perpendicularly oriented with respect to the hands and the forearms of the user, whereas the cross brace is parallel with and positioned in between the hands and the forearms of the user;

wherein the bar has a diameter less than or equal to a diameter of the barbell;

wherein the cross brace can be adjusted in length, and is further defined by a first piece and a second piece; wherein the first piece has a plurality of holes running the length; whereas the second piece has a spring-loaded pin that interlocks with one of the holes to define the length of the cross brace when in use.

10. The barbell having parallel forearm engaging bar as described in claim 9 wherein the foam pads have a diameter greater than or equal to the overall diameter of the second foam pads.

11. The barbell having parallel forearm engaging bar as described in claim 9 wherein the bar has an overall length less than an overall length of the barbell.

12. The barbell having parallel forearm engaging bar as described in claim 9 wherein the clamping assemblies include a setscrew that tightens onto an outer surface of either the barbell or the bar to secure the clamping assembly thereon.

13. A barbell having parallel forearm engaging bar comprising:

a cross brace having a clamping assembly mounted at each end which attaches to a barbell and said bar;

wherein the barbell and the bar are parallel with respect to one another and are separated by a distance defined by a length of the cross brace;

wherein the barbell is configured to be held by the hands of a user and the bar is configured to engage forearms of said user in order to distribute weights on said barbell between the hands and the forearms, which reduces muscular strain to the hands and wrists of said user when performing curling exercises with the barbell;

wherein the clamping assemblies include a setscrew that tightens onto an outer surface of either the barbell or the second bar to secure the clamping assembly thereon;

wherein foam pads are added to the barbell to provide a surface for hands of the end user to grab;

wherein second foam pads are added to the second bar to provide a surface for forearms to engage;

wherein the barbell and the bar are perpendicularly oriented with respect to the hands and the forearms of the user, whereas the cross brace is parallel with and positioned in between the hands and the forearms of the user;

wherein the foam pads have a diameter greater than or equal to the overall diameter of the second foam pads;

wherein the bar has an overall length less than an overall length of the barbell.

14. The barbell having parallel forearm engaging bar as described in claim 13 wherein the bar has a diameter less than or equal to a diameter of the barbell.

15. The barbell having parallel forearm engaging bar as described in claim 13 wherein the cross brace can be adjusted in length, and is further defined by a first piece and a second piece; wherein the first piece has a plurality of holes running the length; whereas the second piece has a spring-loaded pin that interlocks with one of the holes to define the length of the cross brace when in use.

* * * * *